US006774856B2

(12) United States Patent
Back et al.

(10) Patent No.: US 6,774,856 B2
(45) Date of Patent: Aug. 10, 2004

(54) EXTERNAL MOUNTING TYPE MICROCHIP DUAL BAND ANTENNA ASSEMBLY

(75) Inventors: Seok Hyun Back, Incheon-shi (KR); Jin Myeong Kim, Seoul (KR); Byeong Gook Kim, Daejeon-shi (KR); Dae Hyeon Jeong, Seoul (KR); Yeong Jo Kang, Kyunggi-do (KR); Hyeok Joo Kwon, Kangseo-gu (KR)

(73) Assignee: Kosan I & T Co., Ltd., Seoul (KR)

( * ) Notice: Subject to any disclaimer, the term of this patent is extended or adjusted under 35 U.S.C. 154(b) by 0 days.

(21) Appl. No.: 10/198,800

(22) Filed: Jul. 18, 2002

(65) Prior Publication Data

US 2003/0214440 A1 Nov. 20, 2003

(30) Foreign Application Priority Data

May 15, 2002 (KR) ..... 10-2002-0026837

(51) Int. Cl.[7] ..... H01Q 1/24

(52) U.S. Cl. ..... 343/702; 343/700 MS; 343/906

(58) Field of Search ..... 343/702, 700 MS, 343/895, 906

(56) References Cited

U.S. PATENT DOCUMENTS 6,344,827 B1 * 2/2002 Wu ..... 343/702

* cited by examiner

*Primary Examiner*—Hoang V. Nguyen
(74) *Attorney, Agent, or Firm*—Snell & Wilmer L.L.P.

(57) ABSTRACT

Disclosed is an external mounting type microchip dual band antenna assembly including a microchip dual band antenna connected to a printed circuit board which is disposed in a case of a portable terminal. The microchip dual band antenna comprises upper and lower patch elements respectively surrounding lengthwise upper and lower ends of a dielectric body having a shape of a quadrangular prism; a first radiation patch placed on a front surface of the dielectric body to extend zigzag from the upper patch element toward the lower patch element; a second radiation patch placed on a rear surface of the dielectric body to extend zigzag from the upper patch element toward the lower patch element in a manner such that zigzag configurations of the first and second radiation patches are staggered with each other; and a feeder channel defined on a side surface of the dielectric body adjacent to the lower patch element and plated in such a way as to connect the first and second radiation patches with each other.

6 Claims, 10 Drawing Sheets

Marker 1: 880 MHz

Marker 2: 960 MHz

Marker 3: 1,710 MHz

Marker 4: 1,880 MHz

Marker 4: 1,990 MHz

Marker 1; 1:2.5627 MHz

880 MHz

Marker 2; 1:2.4321 MHz

960 MHz

Marker 3; 1:2.0179 MHz 1,710 MHz

Marker 4; 1:1.8757 MHz 1,880 MHz

Marker 5; 1:2.2649 MHz 1,990 MHz

Marker 1: 124.54Ω
880 MHz
Marker 2: 48.205Ω
960 MHz
Marker 3: 38.104Ω
1,710 MHz
Marker 4: 42.947Ω
1,880 MHz
Marker 5: 29.725Ω
1,990 MHz GSM : 1 dBi DCS : 2 dBi

EXTERNAL MOUNTING TYPE MICROCHIP DUAL BAND ANTENNA ASSEMBLY

This application claims priority of Korean Patent Application Serial No. 10-2002-0026837 filed on May 15, 2002

FIELD OF INVENTION

The present invention relates to an external mounting type microchip dual band antenna assembly, and more particularly, the present invention relates to an external mounting type microchip dual band antenna assembly which can achieve in two frequency bands a return loss and a voltage standing wave ratio (VSWR) appropriate to a communication terminal, accomplish a satisfactory radiation pattern, be minimized in its size, and be installed on various radio communication equipment in a miniaturized state.

BACKGROUND OF THE INVENTION

These days, with miniaturization of portable mobile communication terminals, internal mounting type antennas have been disclosed in the art. Further, as various communication services are rendered, in order to ensure high communication quality, microchip antennas, which are small-sized, lightweight and capable of overcoming disadvantages of external mounting type antennas, have been developed. Among the microchip antennas, a dual band antenna is highlighted since it can satisfy several kinds of services in an integrated manner.

However, in the conventional art, a drawback exists in that the microchip antenna cannot properly solve problems associated with miniaturization and design of a communication terminal, and it is inherently difficult to expand a bandwidth in the dual band antenna. In particular, since most of the conventional antennas are externally mounted to the communication terminal, impedance matching circuits are employed, and therefore, the number of processes and a manufacturing cost are increased.

SUMMARY OF THE INVENTION

Accordingly, the present invention has been made in an effort to solve the problems occurring in the related art, and an object of the present invention is to provide an external mounting type microchip dual band antenna assembly which can achieve a return loss and a VSWR appropriate to a dual band, accomplish a satisfactory radiation pattern, and be installed on various radio communication equipment in a miniaturized state.

In order to achieve the above object, according to one aspect of the present invention, there is provided an external mounting type microchip dual band antenna assembly including a microchip dual band antenna connected to a printed circuit board which is disposed in a case of a portable terminal, the microchip dual band antenna comprising: upper and lower patch elements respectively surrounding lengthwise upper and lower ends of a dielectric body having the shape of a quadrangular prism; a first radiation patch placed on a front surface of the dielectric body to extend zigzag from the upper patch element toward the lower patch element; a second radiation patch placed on a rear surface of the dielectric body to extend zigzag from the upper patch element toward the lower patch element in a manner such that zigzag configurations of the first and second radiation patches are staggered with each other; and a feeder channel defined on a side surface of the dielectric body adjacent to the lower patch element and plated in such a way as to connect the first and second radiation patches with each other.

According to another aspect of the present invention, there is provided an external mounting type microchip dual band antenna assembly comprising: a microchip dual band antenna connected to a printed circuit board which is disposed in a case of a portable terminal, and projecting out of the case to be erected in a vertical direction; a connector coupled to the printed circuit board disposed in the case, for supporting a lower end of the microchip dual band antenna; and a cap enveloping and protecting the microchip dual band antenna which projects out of the case and stands vertically erect.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION

Figure 1:
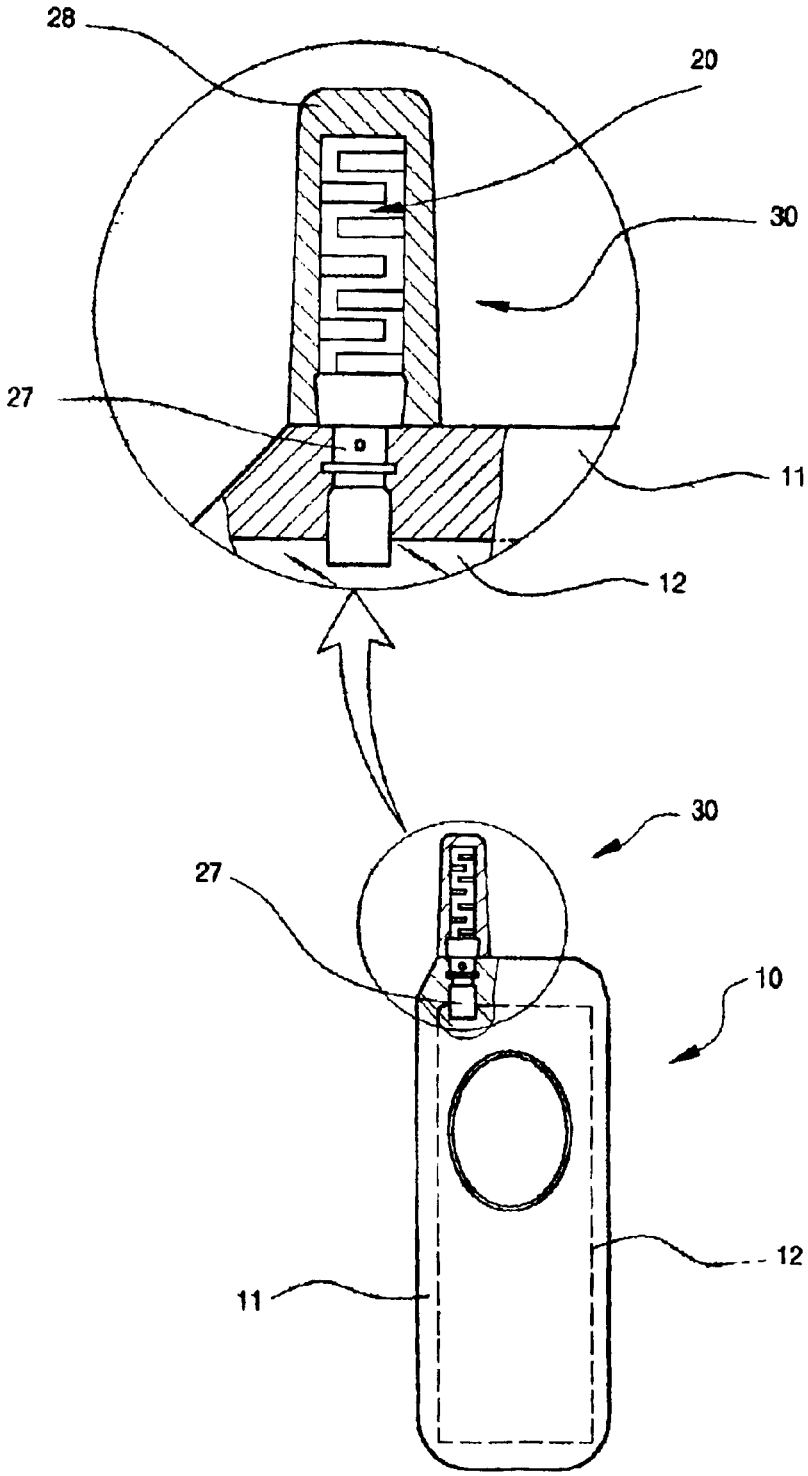
FIG. 1 is a partially enlarged and broken-away front view illustrating a portable radiotelephone to which an external mounting type microchip dual band antenna assembly according to the present invention is employed.

Reference will now be made in greater detail to a preferred embodiment of the invention, an example of which is illustrated in the accompanying drawings. Wherever possible, the same reference numerals will be used throughout the drawings and the description to refer to the same or like parts.

With the advent of the information era, as an individual's social and economic activities are gradually increased and importance of information transmission is emphasized, a system for allowing a person to exchange information irrespective of time, place and the other party is needed.

In order to meet this need, a personal communication service (PCS) phone serving as a next-generation mobile communication system provides at a reasonable service charge a communication quality approaching to that of a wired telephone, realizes portability, miniaturization and light weight, and contributes to construction of a multimedia communication environment by affording data service, etc.

Meanwhile, in a digital mobile handset which is developed to improve limited channel capacity, low communication quality, degraded performance, etc. of an analog communication system, by the fact that voice is coded in its entirety, security is ensured, errors can be easily corrected, an interference-resistant characteristic is improved, and channel capacity is increased.

Multiple access methods used in a digital communication network are divided into a code division multiple access (CDMA) and a time division multiple access (TDMA). Capacity of each channel is limited by a frequency bandwidth and an assigned time. It is to be noted that, even in the case of digital type cellular mobile communication, a problem may be caused due to multipath fading and frequency reuse.

At this time, in the case of CDMA, no limitation is imposed on frequency reuse. However, in the case of TDMA, in order to reuse the same frequency, two cells must be sufficiently separated from each other so that they are not interfered with each other.

A group special mobile (GSM) employing the TDMA method is a cellular system which is operated in the 900 MHz band dedicated for the entire European area. The GSM system provides advantages in terms of signal quality, service charge, international roaming support, frequency band utilization efficiency, and so forth.

A personal communication network (PCN) which is obtained by upbanding the GSM serves as a digital cellular system (DCS) which is operated in the 1,800 and 1,900 MHz bands. Since the PCN is based on the GSM and employs a subscriber identification module (SIM), its roaming with the GSM is enabled.

The present invention is related with an external mounting type microchip dual band antenna assembly 30 which can be reliably used in a dual band including GSM and DCS bands. Detailed description thereof will be given hereafter.

Figure 2:
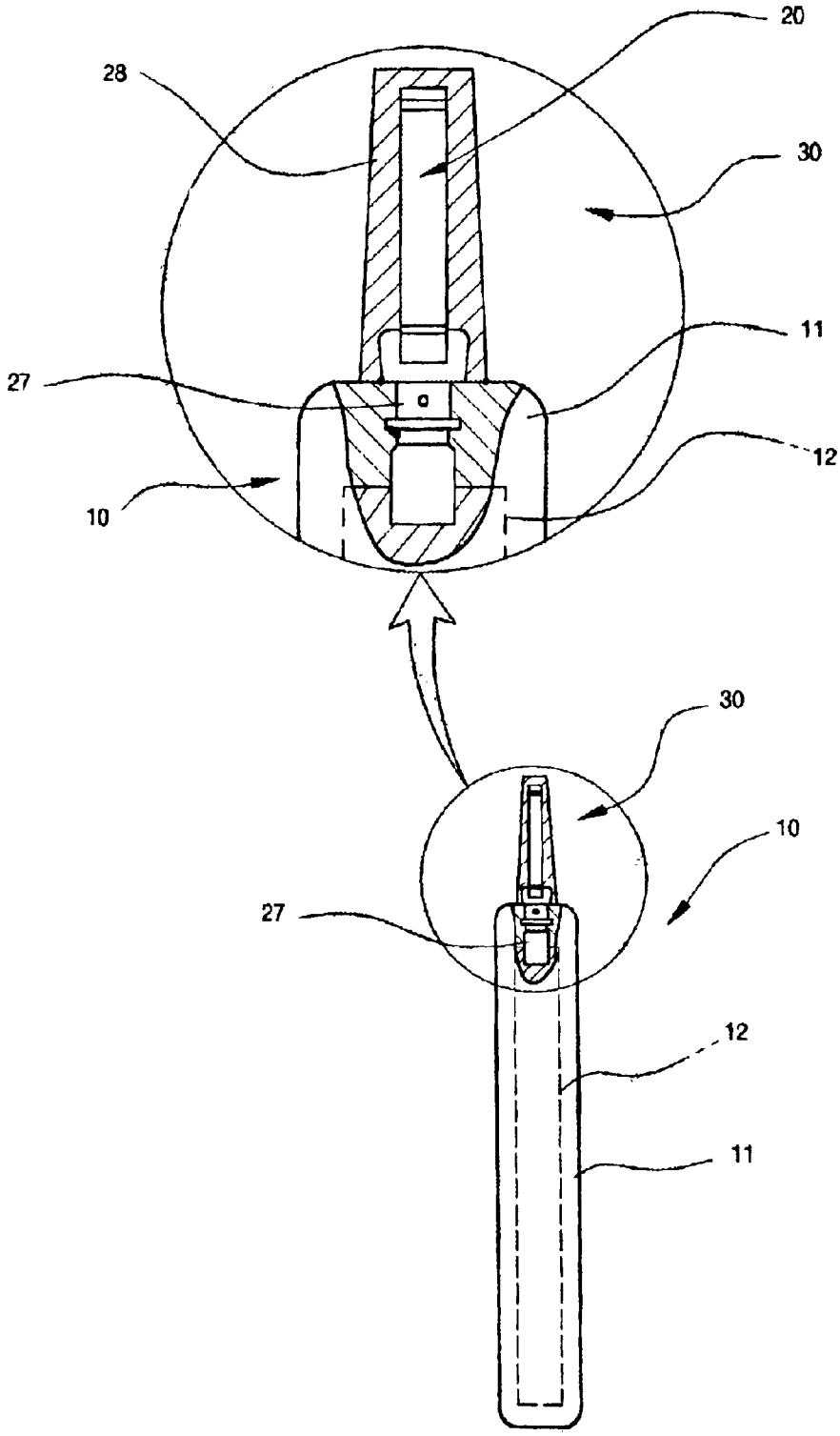
FIG. 2 is a partially enlarged and broken-away side view illustrating the portable radiotelephone to which the external mounting type microchip dual band antenna assembly according to the present invention is employed.

FIG. 1 is a partially enlarged and broken-away front view illustrating a portable radiotelephone 10 to which an external mounting type microchip dual band antenna assembly 30 according to the present invention is employed; and FIG. 2 is a partially enlarged and broken-away side view illustrating the portable radiotelephone 10 to which the external mounting type microchip dual band antenna assembly 30 according to the present invention is employed. The external mounting type microchip dual band antenna assembly 30 comprises a microchip dual band antenna 20. The microchip dual band antenna 20 is connected to a printed circuit board 12 which is disposed in a case 11 of the portable terminal 10 and projects out of the case 11 to be erected in a vertical direction.

A connector 27 is coupled to a lower end of the microchip dual band antenna 20 and connected to the printed circuit board 12 which is disposed in the case 11. A portion of the microchip dual band antenna 20, which projects out of the case 11 and stands vertically erect, is enveloped by a cap 28 to be protected.

Figure 3:
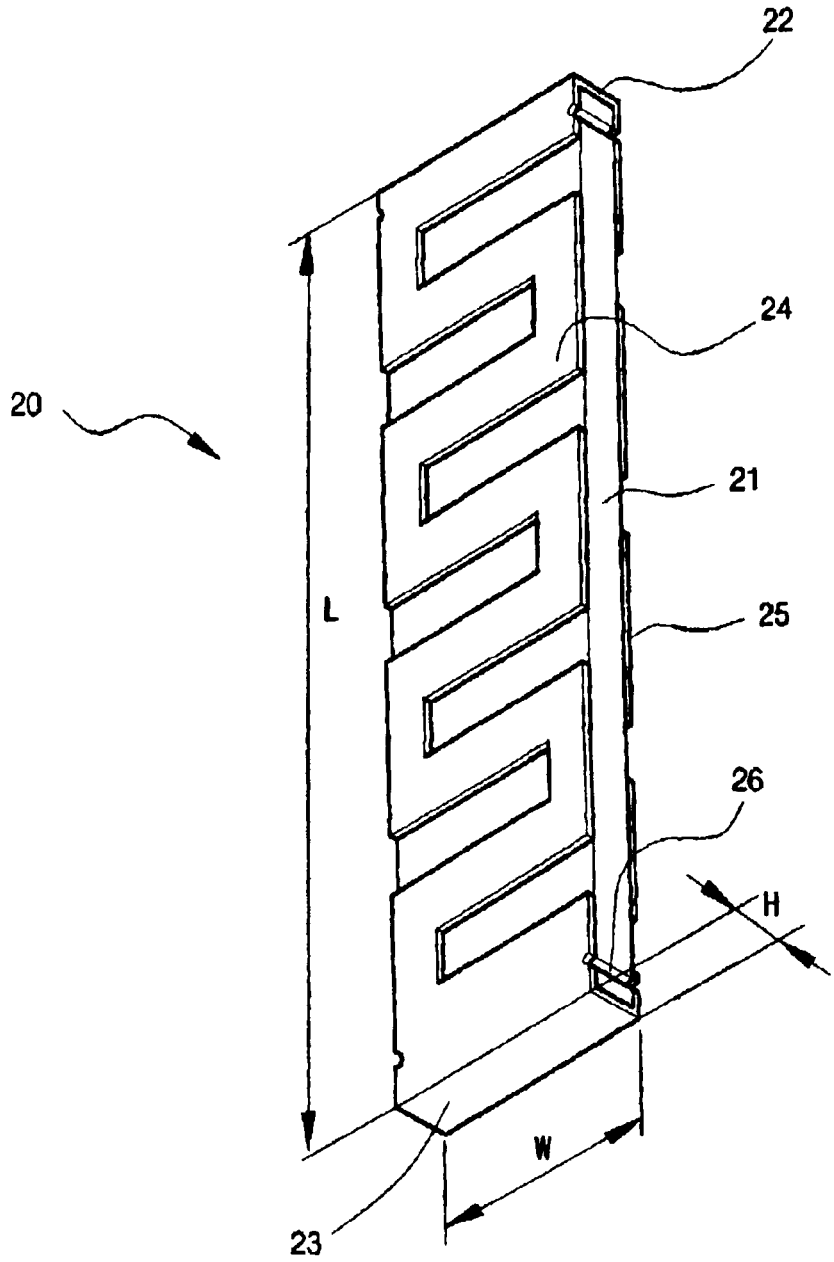
FIG. 3 is a perspective view illustrating a microchip dual band antenna which is applied to the external mounting type microchip dual band antenna assembly according to the present invention.
Figure 4:
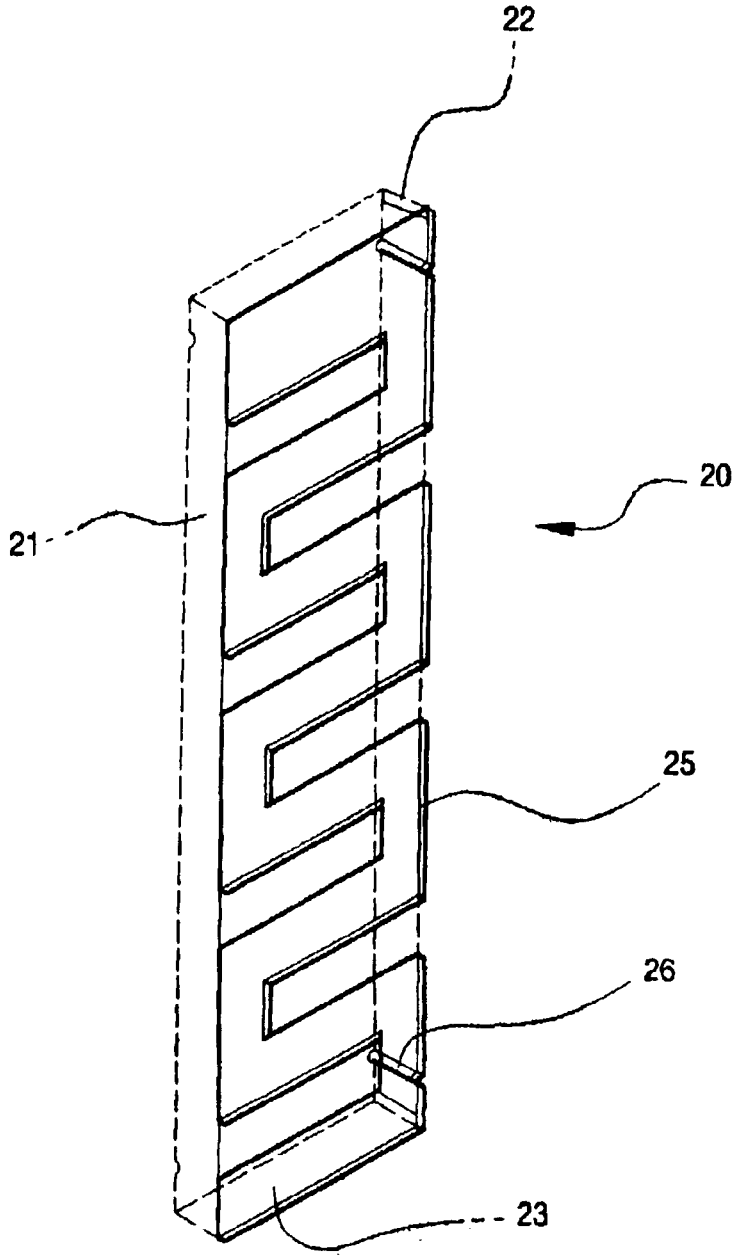
FIG. 4 is a schematic perspective view illustrating a rear part of the microchip dual band antenna which is applied to the external mounting type microchip dual band antenna assembly according to the present invention.

FIG. 3 is a perspective view illustrating the microchip dual band antenna 20 which is applied to the external mounting type microchip dual band antenna assembly 30 according to the present invention. In this preferred embodiment of the present invention, the dielectric body 21 which is formed into the shape of a quadrangular prism has a length L of 20 mm, a width W of 5 mm and a height H of 3.2 mm. FIG. 4 is a schematic perspective view illustrating a rear pair of the microchip dual band antenna 20 which is applied to the external mounting type microchip dual band antenna assembly 30 according to the present invention. By omitting or contouring the dielectric body 21 using a dashed line, an appearance of the rear part can be confirmed. The dielectric body 21 of the microchip dual band antenna 20 is formed of epoxy to reduce a manufacturing cost.

Figure 5:
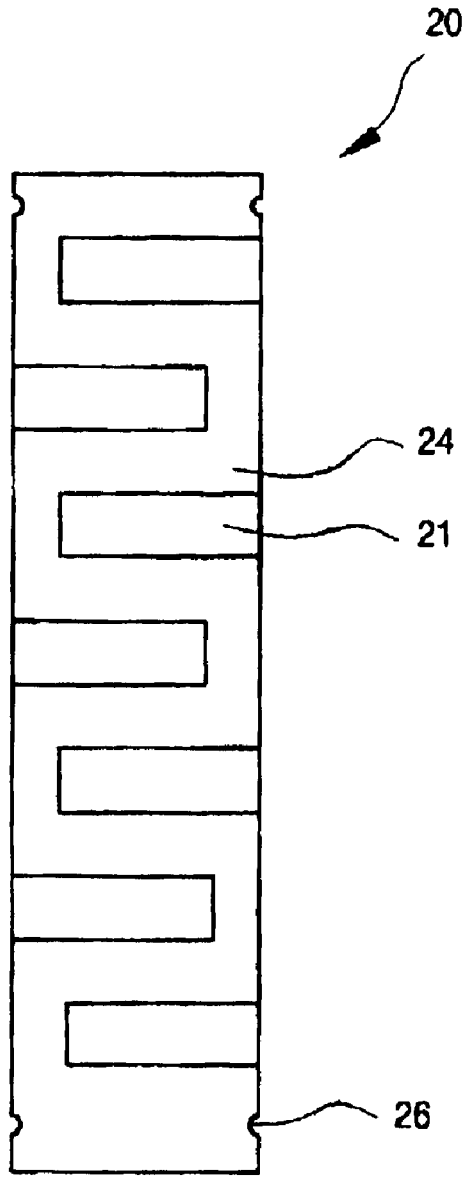
FIG. 5 is a front view illustrating the microchip dual band antenna which is applied to the external mounting type microchip dual band antenna assembly according to the present invention.
Figure 6:
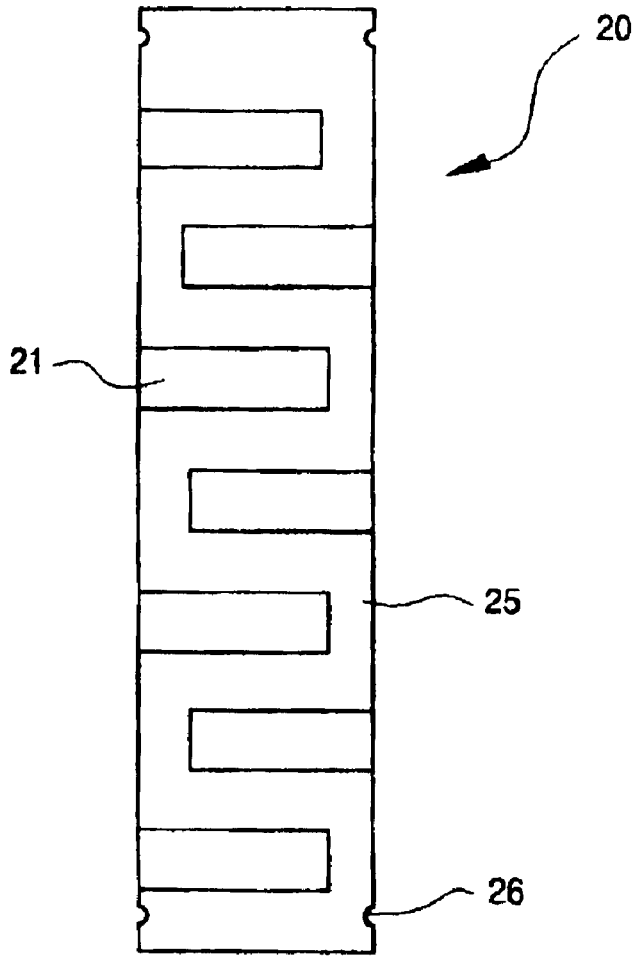
FIG. 6 is a rear view illustrating the microchip dual band antenna which is applied to the external mounting type microchip dual band antenna assembly according to the present invention.

FIG. 5 is a front view of the microchip dual band antenna 20 which is applied to the external mounting type microchip dual band antenna assembly 30 according to the present invention, clearly illustrating a first radiation patch 24, and FIG. 6 is a rear view illustrating the microchip dual band antenna 20 which is applied to the external mounting type microchip dual band antenna assembly 30 according to the present invention, clearly illustrating a second radiation patch 25.

As shown in FIGS. 3 through 6, the microchip dual band antenna 20 which is applied to the external mounting type microchip dual band antenna assembly 30 according to the present invention includes upper and lower patch elements 22 and 23 which respectively surround lengthwise upper and lower ends of the dielectric body 21 having the shape of a quadrangular prism.

The first radiation patch 24 is placed on a front surface of the dielectric body 21 to extend zigzag from the upper patch element 22 toward the lower patch element 23. The first radiation patch 24 resonates, for example, in a GSM band. The second radiation patch 25 is placed on a rear surface of the dielectric body 21 to extend zigzag from the upper patch element 22 toward the lower patch element 23 in a manner such that zigzag configurations of the first and second radiation patches 24 and 25 are staggered with each other. The second radiation patch 25 resonates, for example, in a DCS band.

Since the first and second radiation patches 24 and 25 are respectively placed on the front and rear surfaces of the dielectric body 21 so that their zigzag configurations are staggered with each other, radiation influence and interference between them can be minimized. In one embodiment, the first radiation patch 24 can be operated in the 900 MHz band, and the second radiation patch 25 can be operated in the 1,800 or 1,900 MHz band.

A feeder channel 26 is defined on a side surface and adjacent to the lower patch element 23 of the dielectric body 21. The feeder channel 26 is plated in such a way as to connect the first and second radiation patches 24 and 25 with each other. The feeder channel 26 is connected to the connector 27 and circuit-matched to the printed circuit board 12 which is disposed in the case 11.

Due to the fact that, as described above, the external mounting type microchip dual band antenna assembly 30 according to the present invention employs, by way of the single feeder channel 26, the first and second radiation patches 24 and 25 placed on the front and rear surfaces of the dielectric body 21, that is, the dual band, operation in the GSM and DCS bands (that is, in the dual band) can be reliably implemented in the mobile communication. Also, because the present microchip dual band antenna assembly 30 is externally mounted to the mobile communication terminal 10, when compared to the conventional helical antenna or monopole antenna, miniaturization of the terminal is made possible. Further, as the microchip dual band antenna 20 is coupled through the connector 27 to the printed circuit board 12 and then enveloped by the cap 28, assemblability and portability of the portable radiotelephone 10 can be significantly improved. Besides, through cooperation of the first and second radiation patches 24 and 25 with the dielectric body 21, it is possible to actively overcome problems related with non-uniform distribution of electric force lines.

The external mounting type microchip dual band antenna assembly 30 according to the present invention can be used in a personal mobile communication service employing a cellular phone and a PCS phone, a wireless local looped (WLL) service, a future public land mobile telecommunication service (FPLMTS), and radio communication including satellite communication, so that it can be easily adapted to transmission and receipt of signals between a base station and the portable terminal 10.

In the conventional art, since the microstrip stacked antenna belongs, in its inherent characteristic, to a resonance antenna, disadvantages are caused in that a frequency bandwidth is considerably decreased to several percents and a radiation gain is low. Due to this low radiation gain, because a plurality of patches must be arrayed or stacked one upon another, a size and a thickness of the antenna cannot but be increased. For this reason, when the conventional microstrip stacked antenna is mounted to a personal portable terminal, or used as an antenna for a portable communication transmitter or in radio communication equipment, etc., difficulties are caused.

However, the microchip dual band antenna 20 which is applied to the external mounting type microchip dual band antenna assembly 30 according to the present invention has a wide frequency bandwidth and a decreased leakage current, whereby a high gain is obtained. In particular, as a VSWR is improved and a size of the antenna is decreased, miniaturization of various radio communication equipment is made possible.

Hereafter, characteristics of the microchip dual band antenna 20 which is applied to the external mounting type microchip dual band antenna assembly 30 according to the present invention, which is utilized as stated above, will be described in detail.

Figure 7:
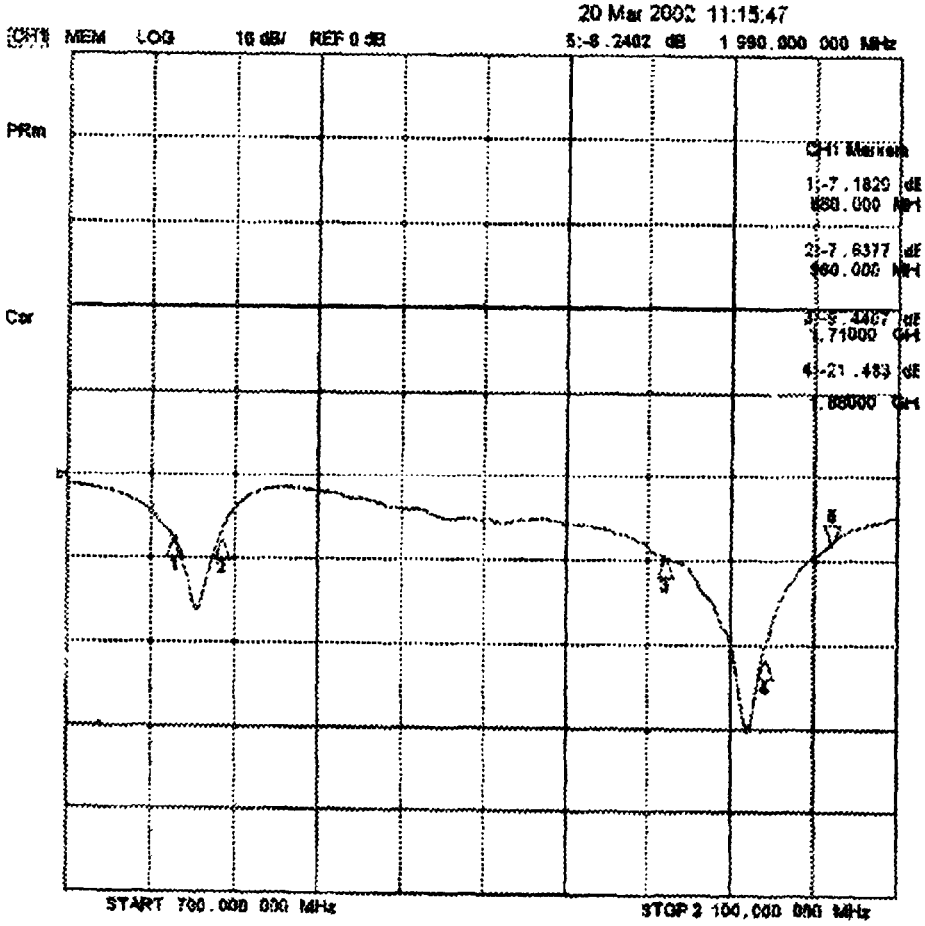
FIG. 7 is a graph illustrating a relationship between a frequency and a return loss in the microchip dual band antenna which is applied to the external mounting type microchip dual band antenna assembly according to the present invention.

FIG. 7 is a graph illustrating a relationship between a frequency and a return loss in the microchip dual band antenna 20 which is applied to the external mounting type microchip dual band antenna assembly 30 according to the present invention.

As shown in FIG. 7, a service band of the microchip dual band antenna 20 which is applied to the external mounting type microchip dual band antenna assembly 30 according to the present invention is realized as a dual band including 880~960 MHz (see Marker 1~Marker 2) by the first radiation patch 24 and 1,710~1,990 MHz (see Marker 3~Marker 5) by the second radiation patch 25.

Figure 8:
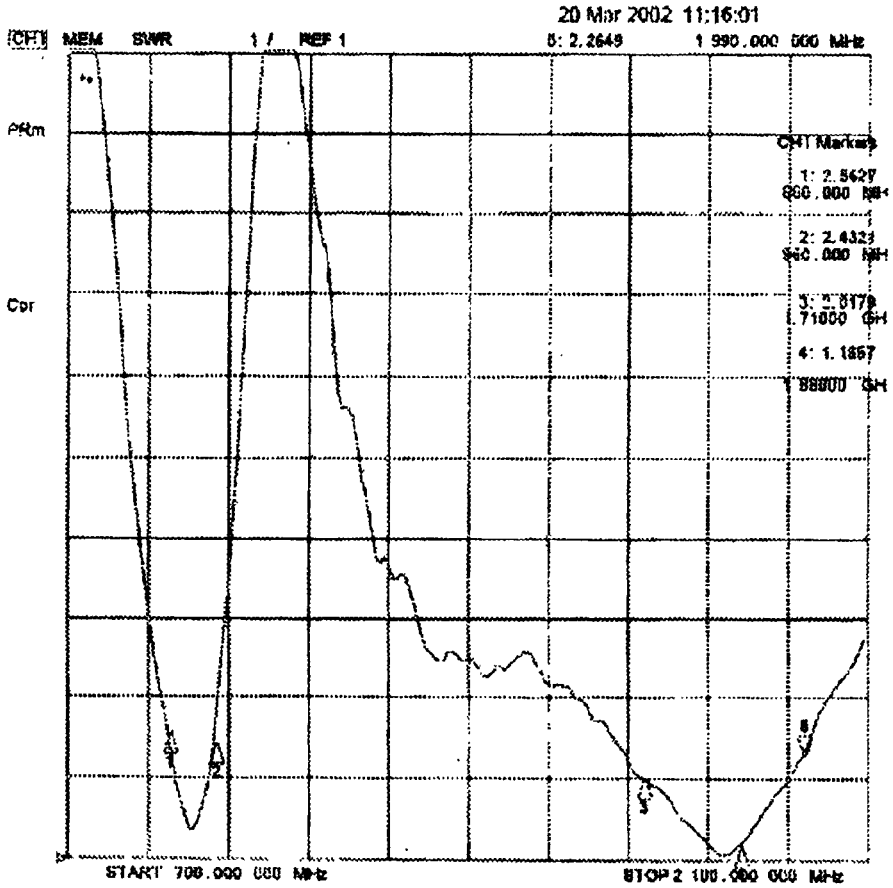
FIG. 8 is a graph illustrating a relationship between a frequency and a voltage standing wave ratio (VSWR) in the microchip dual band antenna which is applied to the external mounting type microchip dual band antenna assembly according to the present invention.

FIG. 8 is a graph illustrating a relationship between a frequency and a voltage standing wave ratio (VSWR) in the microchip dual band antenna 20 which is applied to the external mounting type microchip dual band antenna assembly 30 according to the present invention. As can be readily seen from FIG. 8, in an operating frequency band of the GSM, a maximum VSWR of 1:2.4321~2.5627 is obtained with a resonance impedance of 50 Ω, and in an operating frequency band of the DCS, a maximum VSWR of 1:1.8757~2.2649 is obtained with a resonance impedance of 50 Ω.

That is to say, when assuming that 1 is an ideal VSWR value in the microchip dual band antenna 20, in the Marker 1 included in the GSM band, a VSWR of 2.5627 is obtained at a frequency of 880 MHz, and in the Marker 2, a VSWR of 2.4321 is obtained at a frequency of 960 MHz. In the Marker 3 included in the DCS band, a VSWR of 2.0179 is obtained at a frequency of 1,710 MHz. Also, in the Marker 4, a VSWR of 1.8757 is obtained at a frequency of 1,880 MHz, and in the Marker 5, a VSWR of 2.2649 is obtained at a frequency of 1,990 MHz. As a consequence, it is to be readily understood that excellent VSWRs are obtained in the GSM and DCS bands with respect to the resonance impedance of 50 Ω.

Figure 9:
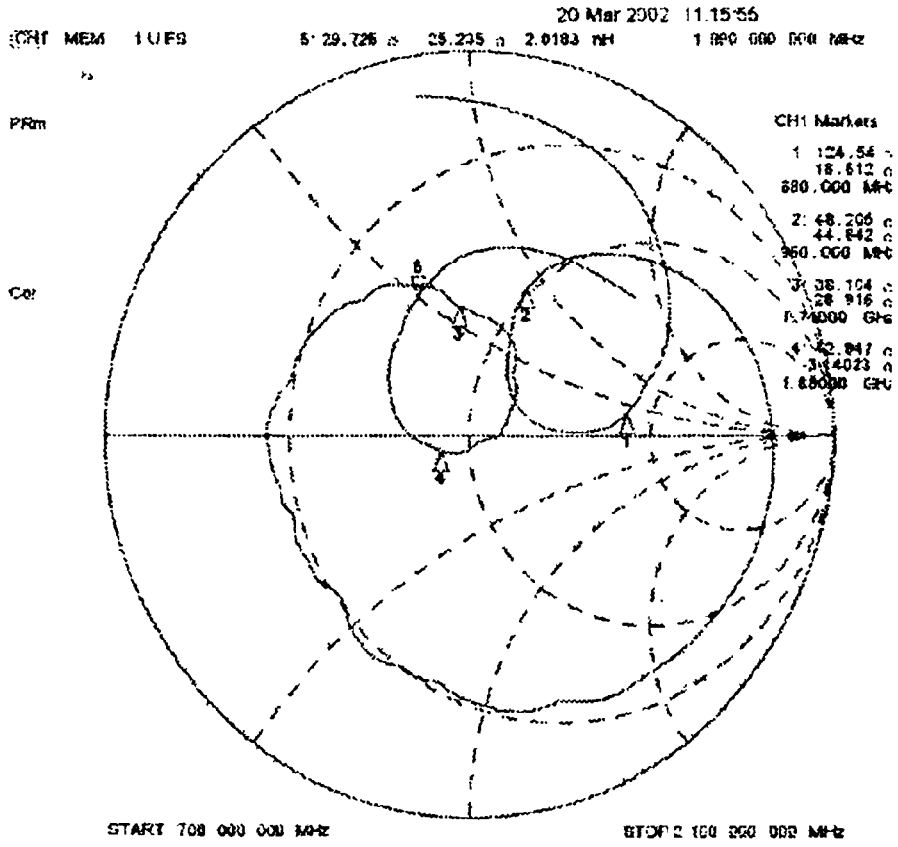
FIG. 9 is a Smith chart explaining the microchip dual band antenna which is applied to the external mounting type microchip dual band antenna assembly according to the present invention.

FIG. 9 is a Smith chart explaining the microchip dual band antenna 20 which is applied to the external mounting type microchip dual band antenna assembly 30 according to the present invention.

As shown in FIG. 9, when the resonance impedance of 50 Ω is taken as a reference in the GSM and DCS frequency bands, in the Marker 1 included in the GSM band, a resonance impedance of 124.54 Ω is obtained at the frequency of 880 MHz, and in the Marker 2, a resonance impedance of 48.250 Ω is obtained at the frequency of 960 MHz. In the Marker 3 included in the DCS band, a resonance impedance of 38.104 Ω is obtained at the frequency of 1,710 MHz. Also, in the Marker 4, a resonance impedance of 42.947 Ω is obtained at the frequency of 1,880 MHz, and in the Marker 5, a resonance impedance of 29.725 Ω is obtained at the frequency of 1,990 MHz. As a result, in the GSM band, an entire resonance impedance of 48.250~124.54 Ωis realized, and in the DCS band, an entire resonance impedance of 29.725~42.947 Ω is realized. Therefore, the microchip dual band antenna 20 can reliably operate in the dual band situation.

Figure 10:
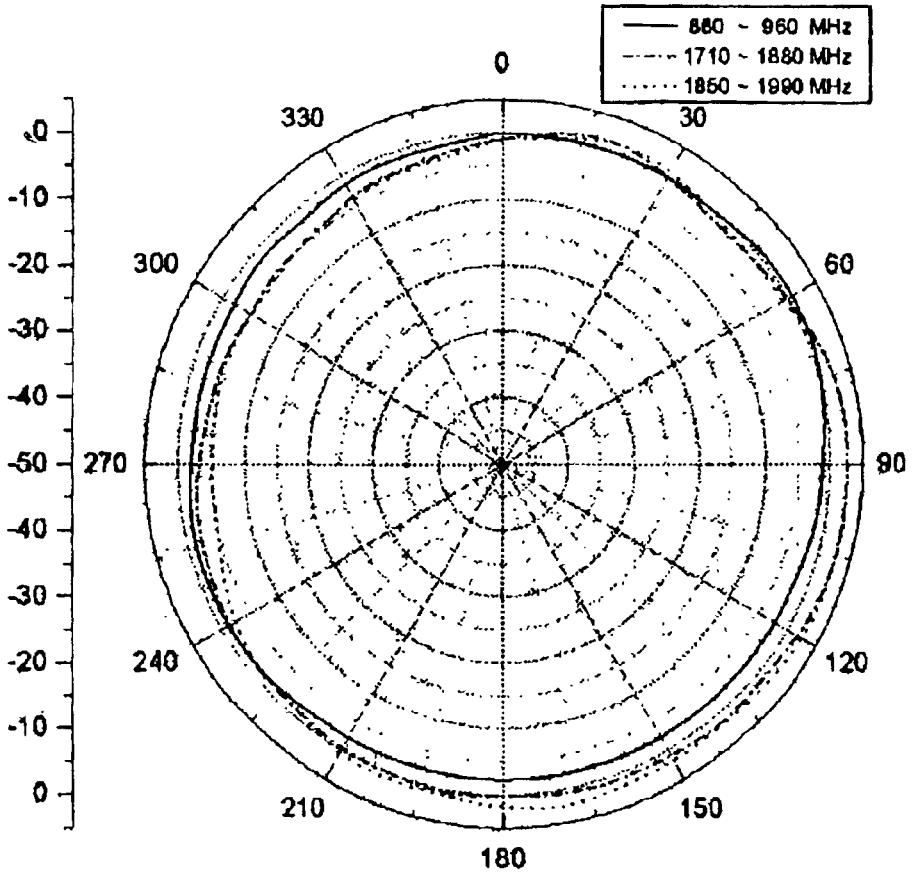
FIG. 10 is a chart explaining a horizontal radiation pattern of the microchip dual band antenna which is applied to the external mounting type microchip dual band antenna assembly according to the present invention.

FIG. 10 is a chart explaining a horizontal radiation pattern of the microchip dual band antenna 20 which is applied to the external mounting type microchip dual band antenna assembly 30 according to the present invention. In FIG. 10, the horizontal radiation pattern is realized as an omnidirectional radiation pattern. Hence, transmission and receipt of signals can be implemented irrespective of a position, whereby a direction-related problem can be effectively solved. At this time, measurement for the microchip dual band antenna 20 which is applied to the external mounting type microchip dual band antenna assembly 30 according to the present invention is executed in an anechoic chamber having no electrical obstacle or in a field having no obstacle within 50 m in each of forward and rearward directions. In this regard, in the present invention, measurement was executed in the anechoic chamber. When measured in the anechoic chamber, a radiation gain of 1 dBi is obtained in the GSM band, and a radiation gain of 2 dBi is obtained in the DCS band. Thus, it is to be appreciated that radiation can be effected in portable mobile communication in a more efficient manner. By measuring radiation patterns on a main electric field surface and a main magnetic field surface of each Marker point, it was found that radiation patterns on the main electric field surface and main magnetic field surface at each measuring frequency reveal omnidirectional characteristics. Therefore, the microchip dual band antenna 20 according to the present invention can be suitably used as an antenna for transmission and receipt of signals in both of the GSM and DCS bands.

As apparent from the above description, the external mounting type microchip dual band antenna assembly according to the present invention provides advantages in that, since first and second radiation patches placed on upper and lower surfaces of a dielectric body are employed by way of a single feeder channel, operation in the dual band (that is, in GSM and DCS bands) can be reliably implemented in a mobile communication field. Also, the present microchip dual band antenna assembly is externally mounted to a mobile communication terminal, so that miniaturization of the terminal is possible. Further, due to the fact that a microchip dual band antenna is easily coupled through a connector to a printed circuit board and enveloped by a cap, assemblability and portability of the portable radiotelephone can be significantly improved. Besides, through cooperation of the first and second radiation patches, it is possible to actively overcome problems related with non-uniform distribution of electric force lines.

Moreover, the microchip dual band antenna applied to the external mounting type microchip dual band antenna assembly according to the present invention can achieve a return loss no greater than −7 dB in the GSM and DCS bands. A sufficient VSWR of 1:2.4321~2.5627 is obtained in an operating frequency band of the GSM, and also, a sufficient VSWR of 1:1.8757~2.2649 is obtained in an operating frequency band of the DCS. Resonance impedances of 48.250~124.54 Ω and 29.725~42.947 Ω are obtained in the GSM and DCS bands, respectively. Horizontal radiation patterns of 1 dBi and 2 dBi are obtained in the GSM and DCS bands, respectively. The horizontal radiation patterns are effected in all directions. The microchip dual band antenna can be used in a personal mobile communication service employing a cellular phone and a PCS phone, a WLL service, an FPLMTS, an IMT-2000, and radio communication including satellite communication, so that it can be easily adapted to transmission and receipt of signals between portable terminals and in a wireless LAN.

In particular, the external mounting type microchip dual band antenna assembly according to the present invention provides advantages in that, since a dual band can be realized, leakage current is decreased to obtain a high gain and a VSWR is improved, the external mounting type microchip dual band antenna assembly can be installed on various radio communication equipment in a miniaturized state.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An external mounting type microchip dual band antenna assembly including a microchip dual band antenna connected to a printed circuit board which is disposed in a case of a portable terminal, the microchip dual band antenna comprising:

upper and lower patch elements respectively surrounding both lengthwise upper and lower ends of a dielectric body having the shape of a quadrangular prism;

a first radiation patch placed on a front surface of the dielectric body to extend zigzag from the upper patch element toward the lower patch element;

a second radiation patch placed on a rear surface of the dielectric body to extend zigzag from the upper patch element toward the lower patch element in a manner such that zigzag configurations of the first and second radiation patches are staggered with each other; and a feeder channel defined on a side surface of the dielectric body adjacent to the lower patch element and plated in such a way as to connect the first and second radiation patches with each other.

2. The external mounting type microchip dual band antenna assembly of claim 1, wherein the antenna is connected to a printed circuit board which is disposed in a case of a portable terminal, and projecting out of the case to be erected in a vertical direction.

3. The external mounting type microchip dual band antenna assembly of claim 1, wherein the dielectric body comprises epoxy.

4. The external mounting type microchip dual band antenna assembly of claim 1, further comprising a connector for coupling the antenna to a printed circuit board.

5. An external mounting type microchip dual band antenna assembly comprising:

a microchip dual band antenna connected to a printed circuit board which is disposed in a case of a portable terminal, and projecting out of the case to be erected in a vertical direction;

a connector coupled to the printed circuit board disposed in the case, for supporting a lower end of the microchip dual band antenna; and a cap enveloping and protecting the microchip dual band antenna which projects out of the case and stands vertically erect.

6. The external mounting type microchip dual band antenna of claim 5, further comprising a feeder channel coupled to the microchip dual band antenna and the connector.

* * * * *